US006766030B1

(12) United States Patent
Chojar

(10) Patent No.: US 6,766,030 B1
(45) Date of Patent: Jul. 20, 2004

(54) HEARING AID RECEIVER WITH EXTERNAL MECHANICAL SHOCK AND VIBRATION DAMPER AND HEARING AID THAT USES IT

(75) Inventor: Sunil Chojar, Lebanon, NJ (US)

(73) Assignee: Sunil Chojar LLC, Clinton, NJ (US)

( * ) Notice: Subject to any disclaimer, the term of this patent is extended or adjusted under 35 U.S.C. 154(b) by 0 days.

(21) Appl. No.: 09/294,167

(22) Filed: Apr. 19, 1999

(51) Int. Cl.[7] ..... H04R 25/00

(52) U.S. Cl. ..... 381/322; 381/368; 381/324; 381/328; 381/361; 181/137

(58) Field of Search ..... 381/322, 324, 381/328, 330, 355, 361, 368, 38, 392, 189, 353, 354; 181/130, 135, 137; 379/52

(56) References Cited

U.S. PATENT DOCUMENTS 4,532,649 A * 7/1985 Bellafiore
4,729,451 A * 3/1988 Brander
4,854,415 A * 8/1989 Goschke
5,887,070 A * 3/1999 Iseberg et al.
6,359,993 B2 * 3/2002 Brimhall
6,473,512 B1 * 10/2002 Juneau et al.

* cited by examiner

*Primary Examiner*—Huyen Le
*Assistant Examiner*—Dionne Harvey

(57) ABSTRACT

Vibration from a hearing aid receiver (and mechanical shock caused by dropping the hearing aid in which it is installed) is damped by a low-durometer elastomeric component that is adhered external to the receiver. The component may be filled with an electrically nonconductive viscous liquid. The component may also be a solid bead or may be provided with a multiplicity of outwardly-extending flexible fingers.

8 Claims, 1 Drawing Sheet

HEARING AID RECEIVER WITH EXTERNAL MECHANICAL SHOCK AND VIBRATION DAMPER AND HEARING AID THAT USES IT

BACKGROUND OF THE INVENTION

The invention relates to hearing aids, and more particularly relates to hearing aid receivers that are used in such aids. In its most immediate sense, the invention relates to shock and vibration-damping hearing aid receivers and to hearing aids in which such receivers are mounted.

Vibration from a hearing aid receiver can be transmitted to the shell of the aid and thereby further transmitted to the faceplate of the aid. Because the faceplate contains one or more microphones, such vibration can cause feedback. To eliminate or reduce such feedback, hearing aid manufacturers have sometimes wrapped the receiver in tape before mounting it in the hearing aid. The tape reduces the mechanical coupling between the receiver and the shell and thereby reduces the likelihood that feedback will result. It is also known to achieve this result by inserting the receiver into an elastomeric boot.

In some applications (such as canal aids or completely-in-canal "CIC" aids), a tape-wrapped or boot-covered receiver cannot practicably be used.

Additionally, labor is required to wrap the receivers with tape or to insert them into boots.

The invention proceeds from the realization that it is feasible for the manufacturer of a hearing aid receiver to provide the hearing aid manufacturer with a receiver to which an external vibration damper has already been fixed (as by adhesive). This would save labor for the hearing aid manufacturer.

In accordance with the invention, a hearing aid receiver is permanently secured to an external vibration damping means. In one embodiment, a sound tube and at least two wires are secured to the receiver. A hollow bladder surrounds the receiver; the bladder is sealed to the sound tube and to the wires. The bladder is of a low durometer elastomer and is filled with an electrically nonconductive fluid. In another embodiment a unitary element of a low durometer elastomer is adhered externally to the receiver. This element can be a solid bead. Alternatively, this element can have a multiplicity of outwardly-extending flexible fingers that envelop the receiver when the receiver is secured to the shell.

When the receiver and vibration damping means attached thereto are inserted into the shell of a hearing aid, the vibration damping means is interposed between the receiver and the shell. As a result, vibration from the receiver is substantially if not completely damped out before it reaches the shell. Because a low durometer elastomer deforms as a result of even low forces exerted against it, even low-amplitude vibrations will cause deformation of the vibration damping means. This makes it possible to reduce the size and the mass of the receiver and vibration damping means without reducing its effectiveness.

Further advantageously, in accordance with the invention there is provided a hearing aid with improved durability. A hearing aid receiver is a delicate component and mechanical shock (such as would be produced by dropping the aid onto a hard surface) can make it nonfunctional. In accordance with the invention, some or all of such mechanical shock will be absorbed by the vibration damping means, making it more likely that a hearing aid in accordance with the invention will continue to operate after a patient drops it.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

Figure 1:
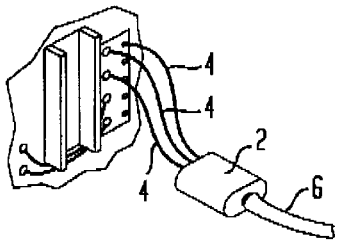
FIG. 1 (PRIOR ART)
FIG. 1 shows a conventional hearing aid receiver.

Although a canal aid is illustrated herein, the invention is suitable for all types of hearing aids. Furthermore, the drawings are not to scale; individual components have been selectively enlarged for clarity. The same element is indicated by the same reference numeral in all the Figures.

Figure 2:
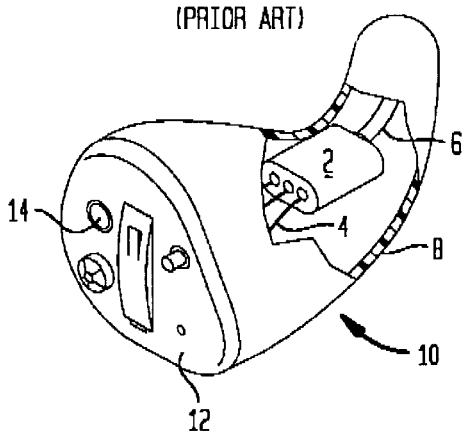
FIG. 2 (PRIOR ART)
FIG. 2 shows a conventional hearing aid receiver installed in a conventional in-ear hearing aid of the canal aid type.

A conventional hearing aid receiver 2 (FIG. 1) has wires 4 (in this example there are three wires 4) and directs sound through a hollow, open-ended sound tube 6. Conventionally (see FIG. 2) the receiver 2 is installed in the shell 8 of a hearing aid generally indicated by reference numeral 10. Ideally, the receiver 2 is held in place by the sound tube 6 and the wires 4 and does not touch the shell 8. If, as is shown in FIG. 2, the receiver 2 touches the shell 8, vibration from the receiver 2 can be transmitted to the shell 8, to the faceplate 12, and to the microphone 14, thereby potentially causing feedback. While it is possible to wrap the receiver 2 in tape (not shown) or to insert it into a boot (not shown) before inserting it into the shell 8, these measures are not certain to adequately damp out the vibration from the receiver 2 to the shell 8. This is because the tape or the boot may not provide sufficient cushioning for the receiver 2, and because the receiver 2 may be too tightly wedged into the shell 8.

Figure 3:
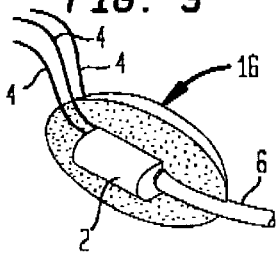
FIG. 3 is a cutaway view of a first preferred embodiment.
Figure 4:
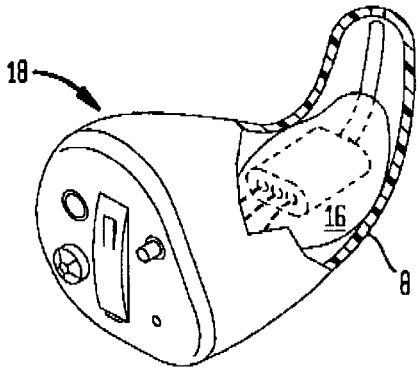
FIG. 4 shows the first preferred embodiment installed in an in-ear hearing aid of the canal aid type.

In accordance with the first preferred embodiment of the invention as illustrated in FIG. 3, a solid foam bead 16 of e.g. polyurethane or other low-durometer elastomer surrounds the receiver 2. (The bead 16 may be molded around the receiver 2 and then cured, as by heat.) Instead of using a solid bead 16 of foam, it may alternatively be advantageous to form the bead 16 as a thin hollow bladder of a low-durometer elastomer such as silicone or neoprene, filled with an electrically nonconductive fluid such as silicone gel or oil. In this instance, the bead 16 would be sealed to the sound tube 6 and to the wires 4 to prevent the fluid from leaking out. (If this alternative is chosen, it may be advantageous to surround the receiver 2 with a hollow tubular sleeve that will form the bladder, to seal the sleeve to the sound tube and to the wires, to inject the fluid through the sleeve, and to seal the port through which the fluid has been injected.)

During use, vibration from the receiver 2 will be converted into heat in the bead 16 and thereby substantially or entirely damped out. This makes it less likely that vibration from the receiver 2 can be the source of feedback in the hearing aid 10.

The first preferred embodiment can advantageously be secured in the shell 16 of a hearing aid generally indicated by reference numeral 18 by adhesive bonding.

Figure 5:
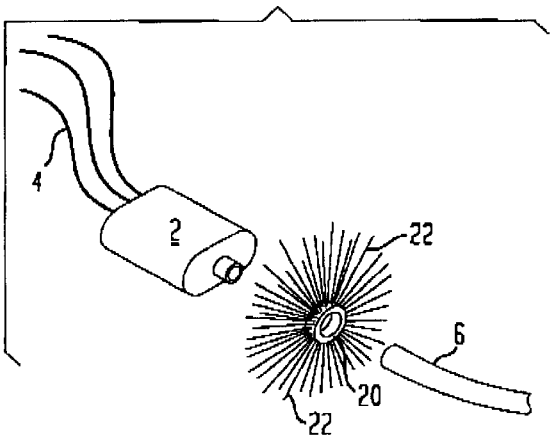
FIG. 5 shows a second preferred embodiment.
Figure 6:
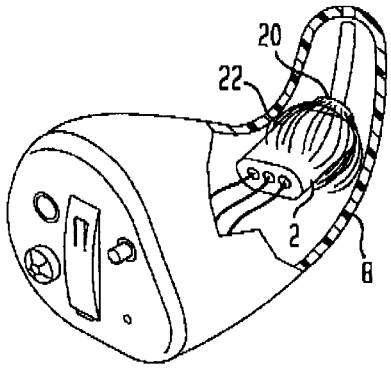
FIG. 6 shows the second preferred embodiment installed in an in-ear hearing aid of the canal aid type.

In accordance with the second preferred embodiment of the invention as illustrated in FIG. 5, a unitary annular element (generally indicated by reference numeral 20) of a low durometer elastomer is adhered (as by adhesive) to the receiver 2. Suitable materials are silicone, neoprene, latex, etc. The element 20 has a multiplicity of outwardly-extending flexible fingers 22 that envelop the receiver 2 when the receiver 2 is secured to the shell 8 (see FIG. 6). In this example, the element 20 is attached around the sound tube 6 and the spout 24 of the receiver 2, but this is not required; the element 20 may surround more or even all of the receiver 2, depending upon the application desired.

Although at least one preferred embodiment of the invention has been described above, this description is not limiting and is only exemplary. The scope of the invention is defined only by the following claims:

What is claimed is:

1. A vibration damper inside a hearing aid housing which includes a receiver to which a set of wires and a flexible hollow sound tube are secured, comprising:

a hollow bladder of a low durometer elastomer, the bladder surrounding the receiver and being sealed to the wires and to the tube; and an electrically nonconductive fluid contained within the bladder.

2. The vibration damper of claim 1, wherein the fluid is a liquid.

3. The vibration damper of claim 2, wherein the liquid is viscous.

4. The vibration damper of claim 2, wherein the bladder is of silicone and the fluid is of silicone gel.

5. A hearing aid, comprising:

a shell;

a hearing aid receiver having at least two wires and a flexible hollow sound tube secured thereto; and means, adhered externally to the hearing aid receiver, for damping vibration from the receiver in a manner that such vibration is at least substantially prevented from being transmitted to the shell, said damping means comprising a hollow bladder of a low durometer elastomer, the bladder surrounding the receiver and being sealed to the wires and to the tube, and an electrically nonconductive fluid contained within the bladder.

6. In combination:

a hearing aid housing which includes a receiver, the receiver having at least two wires and a sound tube connected thereto; and means, adhered externally to the receiver and inside the hearing aid housing, for damping vibration from the receiver, wherein said vibration damping means comprises a hollow bladder of a low durometer elastomer, the bladder surrounding the receiver and being sealed to the wires and to the tube, and an electrically nonconductive fluid contained within the bladder.

7. A hearing aid, comprising:

a shell;

a hearing aid receiver; and means, adhered externally to the hearing aid receiver, for damping vibration from the receiver in a manner that such vibration is at least substantially prevented from being transmitted to the shell, said damping means comprising a unitary element of a low durometer elastomer adhered externally of the receiver and having a multiplicity of outwardly-extending flexible fingers that envelop the receiver when the receiver is secured to the shell.

8. In combination:

a hearing aid receiver having at least two wires and a sound tube connected thereto; and means, adhered externally to the receiver, for damping vibration from the receiver, said means comprising a unitary element of a low durometer elastomer, the element being secured externally to the receiver and having a multiplicity of outwardly-extending flexible fingers.

* * * * *